US006840349B2

(12) United States Patent
Andre et al.

(10) Patent No.: US 6,840,349 B2
(45) Date of Patent: Jan. 11, 2005

(54) MULTI-COMPONENT ACOUSTICALLY RESISTIVE LAYER FOR ACOUSTICAL ATTENUATION PANEL AND PANEL THUS OBTAINED

(75) Inventors: Robert Andre, Auzeville Tolosane (FR); Michel Buge, Saint Sebastien sur Loire (FR); Alain Porte, Colomiers (FR); Eric Rambaud, Les Sorinieres (FR)

(73) Assignee: Airbus France, Toulouse Cedex (FR)

( * ) Notice: Subject to any disclaimer, the term of this patent is extended or adjusted under 35 U.S.C. 154(b) by 63 days.

(21) Appl. No.: 10/413,466

(22) Filed: Apr. 15, 2003

(65) Prior Publication Data

US 2004/0016595 A1 Jan. 29, 2004

(30) Foreign Application Priority Data

Apr. 17, 2002 (FR) ..... 02 04801

(51) Int. Cl.[7] ..... E04B 1/82

(52) U.S. Cl. ..... 181/292; 181/290; 181/291; 181/292; 181/293

(58) Field of Search ..... 181/283, 286, 181/288, 289, 290, 291, 292–293

(56) References Cited

U.S. PATENT DOCUMENTS 4,254,171 A * 3/1981 Beggs et al. ..... 428/116
4,671,841 A 6/1987 Stephens
5,315,820 A 5/1994 Arnold
6,772,857 B2 * 8/2004 Porte et al. ..... 181/210
6,790,520 B1 * 9/2004 Todd et al. ..... 428/318.4

FOREIGN PATENT DOCUMENTS

EP 0 895 222 2/1999
GB 2 130 963 6/1984

* cited by examiner

*Primary Examiner*—Kimberly Lockett
(74) *Attorney, Agent, or Firm*—Young & Thompson

(57) ABSTRACT

A multi-component acoustically resistive layer, for acoustical attenuating panels having a cellular core (1) flanked, on the sound wave arrival side, with an acoustically damping layer (2) and, on the opposite side, with a rear reflector (3), comprises a first structural component (4) in contact with the aerodynamic flow and formed by at least one layer of fibers connected by a suitable resin and oriented in the direction of aerodynamic flow the component (4) comprising a suitable quantity of open surface; a dissipating component (6) disposed against the surface of the first component (4) opposite the flow, formed by a metallic cloth; and a second structural component (7) formed by at least one layer of fibers connected by a suitable resin, oriented orthogonally to the direction of aerodynamic flow. The second structural component (7) is connected to the cellular core (1) and comprises a suitable open surface quantity.

12 Claims, 1 Drawing Sheet

Figure 1:
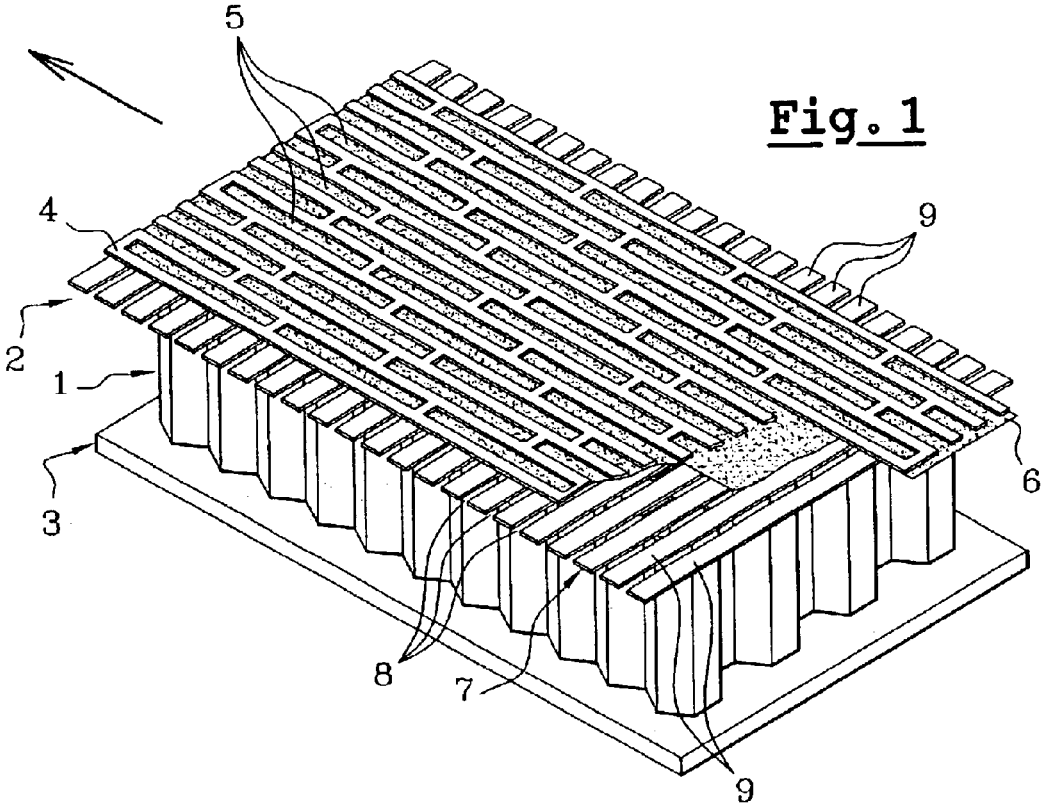

MULTI-COMPONENT ACOUSTICALLY RESISTIVE LAYER FOR ACOUSTICAL ATTENUATION PANEL AND PANEL THUS OBTAINED

The present invention relates to an acoustically resistive layer constituted by a plurality of superposed and connected components and adapted to constitute one of the elements of an acoustic attenuation panel, particularly a panel adapted to be mounted in aircraft turbo reactor nacelle walls.

In practice, this type of panel includes a cellular core, such as a honeycomb structure flanked, on the sound wave arrival side, with an acoustically damping layer and, on the opposite side, with a rear reflector.

The acoustically damping layer is a porous structure with a dissipating role, which is to say partially transforming the acoustic energy of the sound wave passing through it, into heat.

This porous structure can for example be a metallic cloth or a cloth of carbon fibers whose wave permits fulfilling its dissipating function.

These acoustic panels being required, for example in the case of panels for turbo reactor nacelles, also to have sufficient structural properties particularly to receive and transfer aerodynamic and inertial forces and those connected with the maintenance of the nacelle, toward the nacelle/motor structural connections, it is necessary to provide the acoustical damping layer with structural properties.

To this end, it has already been proposed to provide an acoustically damping layer with two superposed components, one structural and the other dissipating and porous, the structural component being either disposed between the porous structure and the dissipating component, as shown in British patent GB 2 130 963, or disposed in contact with the incident sound wave, as shown by the document EP 0 911 803.

The present invention seeks to improve these types of acoustically damping layer by optimizing their capacity to resist forces received by panels provided with such resistive layers, both axially and radially, which forces are generated by the aerodynamic flow, the pressure of the motor and during thrust reversal.

To this end, the invention has for its object a multicomponent acoustically resistive layer, for acoustical attenuation panels of the type constituted by a cellular core flanked, on the sound wave receiving side, with an acoustically damping layer and, on the opposite side, with a rear reflector, characterized in that it is constituted:

- by a first structural component in contact with the aerodynamic flow and formed by at least one layer of fibers connected by a suitable resin and oriented in the direction of aerodynamic flow, said component comprising a suitable open surface proportion;
- by a dissipating component disposed against the surface of said first component opposite said flow, formed by a metallic cloth;
- and by a second structural component formed by at least one layer of fibers connected by a suitable resin, oriented orthogonally to said direction of aerodynamic flow, said second structural component being connected to said cellular core and comprising a suitable open surface proportion.

According to one embodiment, the fibers of the first structural component are constituted by roving or unidirectional layers for example of carbon or glass pre-impregnated with a thermoplastic resin, particularly a resin of the family of polyetheretherketones (PEEK) or of the family of polyetherimides (PEI).

The fibers of the second structural component can also be constituted by roving or unidirectional layers, of carbon or glass, pre impregnated with a thermoplastic or thermosetting resin.

According to another embodiment, the fibers of the first structural component are constituted by a cloth for example of carbon or glass, pre-impregnated with a resin of the PEI type, the weft or warp fibers of said cloth being oriented in the direction of aerodynamic flow.

The fibers of the second structural component can also be constituted by a cloth of carbon or glass, the warp or weft filaments of said cloth being oriented orthogonally to said direction of aerodynamic flow.

Preferably, the first and second structural components have non-circular openings each having their greatest dimension respectively parallel to the direction of aerodynamic flow and orthogonally to this latter, said openings being preferably rectangular.

According to still another embodiment, so as to increase the resistance to force of the first structural component, an intermediate component is interposed between the dissipating component and the second structural component, said intermediate component comprising a suitable proportion of open surface and being formed by at least one layer of fibers for example of carbon or glass connected by a preferably thermoplastic resin, said fibers being oriented in the direction of aerodynamic flow.

The intermediate component is constituted by unidirectional roving or cloth whose warp or weft filaments are oriented in said direction of thermodynamic flow.

Preferably, the intermediate component is disposed identical to the first structural component, acoustically speaking, which is to say with a quantity of open surface identical to the openings of one of the components facing said openings of the other.

The first structural component of such an acoustically resistive layer permits taking up forces generated by aerodynamic flow, as well as those generated by the motor, whilst the second structural component permits taking up orbital or radial forces.

By dissociating the elements that absorb the forces, the absorption of each force is improved.

Moreover, particularly in the case of the provision of a first structural component with rectangular openings longitudinally oriented in the direction of aerodynamic flow, there is obtained a resistive layer that is particularly resistant to tearing off.

The invention also has for its object an acoustically attenuating panel incorporating such an acoustically resistive layer, particularly an air inlet panel for the nacelle of a jet engine, whether constituted by several segments or sectors but joined by clips, or by a single portion comprising a single clip.

Figure 2:
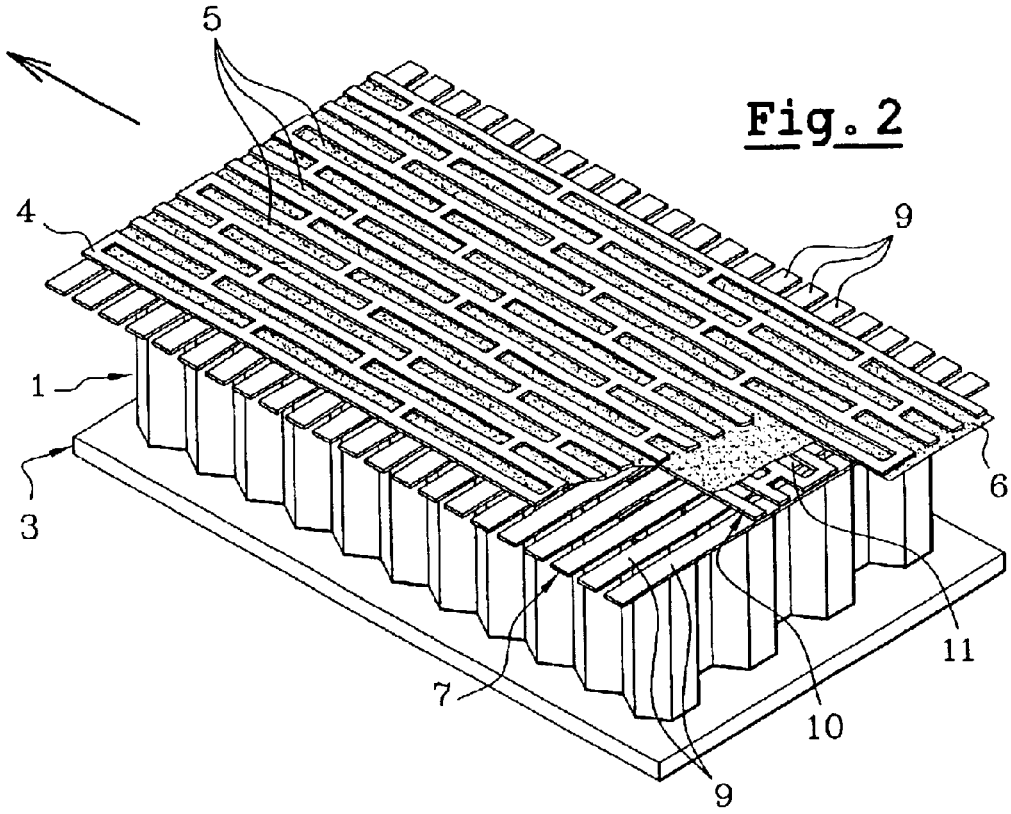

Other characteristics and advantages will become apparent from the description which follows, of embodiments of the device of the invention, which description is given solely by way of example and with respect to the accompanying drawings, in which:

FIG. 1 is a fragmentary perspective view of an acoustically attenuating panel provided with an acoustically resistive layer according to the invention, and FIG. 2 is a view similar to that of FIG. 1, showing a modified embodiment.

In FIG. 1, there is shown a portion of an acoustically attenuating panel for example an air inlet panel of a jet engine nacelle, constituted, in known manner, by a sandwich formed by a central core 1 of the cellular type, flanked on the aerodynamic flow side by an acoustically resistive layer 2 and, on the opposite side, by a total reflector 3.

According to the invention, the acoustically resistive layer 2 is constituted by a first structural component 4 directly in contact with the aerodynamic flow, whose direction is indicated by the arrow.

The first structural component 4 has a suitable proportion of open surface, defined, in the illustrated embodiment, by rectangular openings 5 disposed on the diagonal, aligned longitudinally in the direction of aerodynamic flow.

The component 4 is constituted for example by a sheet of composite material obtained from roving or layers of unidirectional fibers pre-impregnated with a suitable resin, the fibers being oriented in the direction of aerodynamic flow.

The fibers are selected for example from the group comprising fibers of carbon, glass, Kevlar, aramid fibers, carbon or glass fibers being preferably used.

The impregnation resin is preferably a thermoplastic resin and particularly a resin of the family of polyetheretherketones (PEEK) or of the family of polyetherimides (PEI).

The openings 5 are made by cutting out with a press after polymerization of the impregnation resin of the fibers for the purpose of consolidating the composite material.

The composite perforated sheet constituting the component 4 extends over all the surface to be covered of the segment or sector of the panel to be produced. Several identical sheets can be superposed to form the component 4.

Beneath the first structural component 4 is disposed a dissipating component 6 constituted by a metallic cloth or wire mesh, more particularly a cloth of stainless steel.

Between the metallic cloth 6 and the cellular core 1 is interposed a second structural component 7 constituted, in the illustrated embodiment, by unidirectional fibers oriented orthogonally to the direction of aerodynamic flow. These fibers can be of the same type as those of the component 4.

Whilst the resin of the component 4 is preferably of the thermoplastic type ensuring good cohesion between the component 4 and the metal cloth 6, the resin of component 7 can be a thermosetting resin, such as an epoxid resin, which is sufficient to ensure adherence between the component 7 and the other constituents of the panel, the component 7 not being stressed by aerodynamic flow. A thermoplastic can nevertheless be used.

The suitable quantity of open surface of the component 7 can be obtained, as shown, by regular spacings 8 between rovings or groups of fibers 9, the production of the component being obtained by filamentary deposition.

The adhesion between the various constituents 1, 2, 3 of the sandwich is obtained by polymerization of the impregnation resin or resins, in known manner.

The component 4 is in the first instance emplaced on a mandrel (not shown) with the shape of the panel to be produced, the openings 5 being disposed axially of said mandrel.

Then the metallic cloth 6 is emplaced. Next, the rovings or fibers 9 are wound on the mandrel.

Finally, the cellular core 1, as well as the rear reflector 3, are emplaced, the assembly being then stoved or autoclaved for the purpose of polymerization.

On a same mandrel, it is possible to produce simultaneously the various segments or sectors constituting an air inlet panel.

The first structural component 4 can as a modification be constituted by a cloth whose warp or weft filaments are oriented parallel to the direction of aerodynamic flow, the sheet being pierced with openings after consolidation of the composite material.

It is to be noted that the openings provided in the sheet can have various dimensions and be of any shape, circular or non-circular.

The second structural component 7 can be as a modification constituted by a cloth of pre-impregnated fibers, whose warp or weft filaments are oriented orthogonally to the direction of aerodynamic flow, the cloth, after consolidation, being pierced with suitable openings giving to the component the suitable quantity of open surface, the openings being adapted to have various dimensions and any shape, circular or non-circular, relative to the openings of the first component 4.

FIG. 2 shows a modified embodiment of the panel of FIG. 1, in which between the metallic cloth 6 and the second structural component 7 is interposed an intermediate component 10 for reinforcing the action of the first structural component 4. To this end, the intermediate component 10 comprises fibers for example of carbon or glass oriented parallel to the direction of aerodynamic flow and comprises an open surface quantity corresponding to that of the first structural component 4.

Preferably, the impregnation resin for the fibers of component 10 is a resin of the thermoplastic type ensuring better connection with the metallic cloth 6.

The component 10 can be, as shown, identical to the component 4, which is to say formed of one or several composite sheets comprising unidirectional or woven fibers, pierced with openings 11 analogous to openings 5 and facing these latter.

The component 10 can of course have a different construction from that shown, as a function particularly of that of the component 4.

It is to be noted that the cellular core 1 can be constituted by several layers separated by septa.

What is claimed is:

1. Multi-component acoustically resistive layer, for acoustical attenuation panels of the type constituted by a cellular core (1) flanked on the sound wave arrival side, by an acoustically damping layer (2) and, on the opposite side, by a rear reflector (3), characterized in that it is constituted:

by a first structural component (4) in contact with the aerodynamic flow informed by at least one layer of fibers connected by a suitable resin and oriented in the direction of aerodynamic flow, said component (4) comprising a suitable open surface quantity;

by a dissipating component (6) disposed against the surface of said first component (4) opposite said flow, formed by a metallic cloth;

and by a second structural component (7) formed of at least one layer of fibers connected by a suitable resin, oriented orthogonally to said direction of aerodynamic flow, said second structural component (7) being connected to said cellular core (1) and comprising a suitable open surface quantity.

2. Layer according to claim 1, characterized in that the fibers of the first and second structural components (4, 7) are constituted by rovings or unidirectional layers.

3. Layer according to claim 1, characterized in that the first and second structural components (4, 7) are constituted by a cloth whose warp or weft filaments are parallel to said direction of aerodynamic flow.

4. Layer according to claim 2, characterized in that the fibers are fibers of carbon or glass.

5. Layer according to claim 1, characterized in that the fibers of the first structural component (4) are pre-impregnated with a thermoplastic resin.

6. Layer according to claim 1, characterized in that the fibers of the second structural component (7) are pre-impregnated with a thermosetting resin.

7. Layer according to claim 1, characterized in that the first structural component (4) is pierced with non-circular openings, particularly rectangular openings (5) oriented parallel to said direction of aerodynamic flow.

8. Layer according to claim 1, characterized in that the dissipating component (6) is a metallic cloth, particularly of stainless steel.

9. Layer according to claim 1, characterized in that the second structural component (7) is constituted by rovings of parallel fibers (9) providing between them a predetermined spacing (8).

10. Layer according to claim 1, characterized in that it moreover comprises an intermediate component (10) for reinforcing the first structural component (4), interposed between the dissipating component (6) and the second structural component (7), constituted and disposed in a manner identical to the first structural component (4).

11. Layer according to claim 10, characterized in that the first structural component (4) and the intermediate component (10) are constituted by at least one layer of composite material pierced with rectangular openings (5, 11) the openings of the two components (4, 10) facing each other.

12. Acoustically attenuating panel comprising at least one clip, constituted by several segments or sectors whose edges are connected by clipping and each provided with an acoustically resistive layer according to claim 1.

* * * * *